US012768122B2

(12) United States Patent
Kadiu

(10) Patent No.: US 12,768,122 B2
(45) Date of Patent: Oct. 20, 2026

(54) MODULAR SHORING FOR TEMPORARY RETAINING WALL

(71) Applicant: Max Kadiu, Stockton, CA (US)

(72) Inventor: Max Kadiu, Stockton, CA (US)

( * ) Notice: Subject to any disclaimer, the term of this patent is extended or adjusted under 35 U.S.C. 154(b) by 5 days.

(21) Appl. No.: 19/004,404

(22) Filed: Dec. 29, 2024

(65) Prior Publication Data

US 2026/0185319 A1 Jul. 2, 2026

(51) Int. Cl.
*E02D 17/20* (2006.01)

(52) U.S. Cl.
CPC ..... *E02D 17/207* (2013.01); *E02D 2600/30* (2013.01)

(58) Field of Classification Search
CPC ..... E02D 17/08; E02D 17/207; E02B 3/106; E02B 7/08
See application file for complete search history.

(56) References Cited

U.S. PATENT DOCUMENTS 1,408,332 A * 2/1922 Zimmerman ..... 52/153
6,224,296 B1 * 5/2001 Fukumori ..... E02D 17/08 405/282
6,840,711 B1 * 1/2005 Martinez ..... E02B 3/106 405/15
6,848,865 B2 * 2/2005 Kadiu ..... E02D 17/08 405/282
9,157,211 B2 10/2015 Hiester ..... E02D 29/0275 405/284
10,392,770 B2 * 8/2019 Chilton ..... E02D 17/04
2004/0005197 A1 * 1/2004 Kadiu ..... E02D 17/08 405/285
2004/0170478 A1 * 9/2004 Kadiu ..... E02D 17/08 405/282
2005/0074301 A1 * 4/2005 Kadiu ..... E02D 17/083 405/274

(Continued)

FOREIGN PATENT DOCUMENTS

KR 20090091467 A * 8/2009 ..... E02D 17/04
KR 102364430 B1 * 2/2022 ..... E02D 17/083

OTHER PUBLICATIONS

Lee Ki Hwan; KR 102364430 B1; Machine Translation; All; Feb. 2022 (Year: 2022).*

(Continued)

*Primary Examiner* — Benjamin F Fiorello

(57) ABSTRACT

This invention discloses a shoring system comprising rail posts, shoring panels and rakers for supporting temporary retaining walls. Each rail post has lateral guides for sliding shoring panels, and a frontal guide over which slides the raker. The shoring system is modular by mean several rail posts, shoring panels and rakers are used successively to create a temporary shoring wall. The rail posts are designed to adapt any shape of retaining wall, straight, polygonal and/or zig-zag. During the installation, all the components of the shoring system slide vertically relative to each other. Normally, each module of shoring system is set up within excavation after digging few feet. Afterward, the excavator digs in front of the shoring module pushing down the rail posts, the panels and the rakers with its bucket as excavation progresses down to sub-grade. In stable soils the shoring system can be installed after the excavation is complete.

5 Claims, 8 Drawing Sheets

(56) References Cited

U.S. PATENT DOCUMENTS

| | | | | |
|---|---|---|---|---|
| 2009/0142136 | A1* | 6/2009 | Thompson | E02B 3/106 405/114 |
| 2011/0058903 | A1* | 3/2011 | Kadiu | E02D 17/08 405/272 |
| 2014/0219728 | A1* | 8/2014 | Brown | E02D 17/20 405/284 |
| 2014/0308078 | A1* | 10/2014 | Mulvihill | E02B 3/106 405/16 |
| 2016/0362890 | A1 | 12/2016 | Burk | E04C 2/044 |
| 2018/0274190 | A1* | 9/2018 | Nero | E02B 3/106 |

OTHER PUBLICATIONS

Son Sung Gon; KR 20090091467 A; Machine Translation; All; Aug. 2009 (Year: 2009).*

U.S. Appl. No. 14/083,332, filed Feb. 28, 1922, Zimmerman, Andrew J.

* cited by examiner

MODULAR SHORING FOR TEMPORARY RETAINING WALL

CROSS-REFERENCE TO RELATED APPLICATIONS

This invention relates to shoring apparatuses used for the temporary retaining wall, in open cut excavations.

TECHNICAL FIELD

This invention relates to the shoring systems for temporary retaining wall, used to prevent the walls of open excavations to cave in, and secure the safety of the working place. The shoring system comprises large shoring panels, rail posts and rakers. Each rail post has laterally, on each side, at least one lateral guide for sliding shoring panels, and a frontal guide pointing toward the excavation, for sliding one raker. Each rail post is held vertically by the raker which tampers onto the ground inside the excavation. The lateral guides of the rail post are aligned in a manner so that the panels sliding on each side of the rail post can form any angle between 0 and 360 degrees. When the angle of alignment of the lateral guides of the rail posts is 180 degrees the panels sliding on each side of the rail post follow the same alignment forming conjointly a straight shoring wall. When the angle of alignment of the lateral guides of the rail post is 90 degrees the panels outline a 90 degrees turn of shoring wall. Otherwise, for all other angles, the panels will outline a polygonal or a zig-zag shoring wall, or a combination of both. The shoring wall is formed by placing successively rail posts and panels along the excavation wall wherein the rail post are supported by the rakers.

BACKGROUND OF THE INVENTION

Shoring systems comprising rail posts and panels have been disclosed in various US patents. However, all these systems, dubbed slide rail shoring system, comprise in addition of the rail posts and the panels, a bracing system which support the opposing posts against each other. Slide rail shoring systems are disclosed in U.S. Pat. Nos. 3,910,053 and 4,657,442 (Krings), U.S. Pat. Nos. 5,310,289 and 5,503,504 (Hess et al.), U.S. Pat. No. 6,164,874 (May), U.S. Pat. No. 5,310,289 (Hess), EU Pat. No. 0 100 083 (May), U.S. Pat. No. 7,309,191 (Kadiu), etc. These shoring systems are designed for trenches or pits supporting opposing walls of an excavation and cannot be used as retaining wall, by mean of supporting a single excavation wall.

Shoring systems for retaining wall are disclosed in various US and WO patents. The U.S. Pat. No. 9,157,211 B2 (Hiester), discloses a precast cantilevered concrete wall having a base shearkey and blockouts retaining the inadvertent movement of soil embankment. This is a permanent precast retaining wall set in place in adjacent rigid units without moving parts and additional supports. The U.S. Pat. No. 9,856,622 B2 (McIntosh et al.), discloses a method of supporting a retaining wall that includes a number of wall blocks positioned to retain material against a rear side of the plurality of wall blocks. This is yet another permanent retaining wall using concrete blocks placed in row, and on the top of each other, each one having a hollow section filled by supporting piles which also interlock these blocks in place. Other patents or publications, such as U.S. Pat. No. 10,415,241 B2 (Simonson), US Pub. Nos. US 2004/0182038 A1 (Manthei), US Pub. Nos. US 2009/0293415 A1 (alter), disclose monolithic retaining walls formed by modular retaining wall blocks interlocked with each other in various way. The US Pub. Nos. US 2016/0362890 (Burke), discloses a free standing wall panel system including a wall panel member in association with a base member supporting it. All the above mentioned patents and publications lack various elements included in the present invention such as rail posts, rakers sliding panels etc. The US Pub. Nos. US 2014/0219728 A1 (Brown), discloses a retaining wall having multiple piles and panels mounted uprights to the piles for lateral movement. The piles are embedded in to the ground several feet below the base of retaining wall while the panels pivot around the piles via hinges encompassing the pile. This is yet an adjustment of traditional soldier pile & lagging method consisting of embedded soldier piles and panel lagging.

BRIEF SUMMARY OF THE INVENTION

This invention relates to a modular shoring system for temporary retaining shoring wall comprising rail posts, large shoring panels and rakers as described above. Each rail post has lengthwise, laterally on each side, at least one U-shaped guide provided lengthwise with a locking bar to interlock shoring panels sliding within. Each rail post has lengthwise, frontally, pointing into excavation, one edge guide to engage cooperatively into a C-shaped guide provided vertically on to the raker.

Each panel has laterally, on each end, one edge guide to be received cooperatively within lateral guides of the rail post and interlock within.

Each raker has vertically a frontal "C-shaped" guide that encompasses the frontal edge guide of the rail post to slide formlockingly over it. On the opposing side of the frontal guide, the raker has a tubular guide, wherein a tamper slides within to press onto the ground via a pressing plate.

The shoring system is modular by mean several rail posts, shoring panels and rakers are used successively to create a temporary shoring wall. The rail posts are designed to adapt any shape of retaining wall, straight, polygonal and/or zig-zag. During the installation, all the components of the shoring system slide vertically relative to each other. Normally, each module of shoring system is set up within excavation after digging few feet. Afterward, the excavator digs down in front of the shoring module pushing down the rail posts, the panels and the rakers with its bucket as excavation progresses down to sub-grade. Thus, when the excavation reaches the sub-grade the shoring module is also in place. Once installed within excavation, the raker is restrained against the rail post via screws or pins to impede their relative movement. At the end, the shoring panels hold back the excavated soil transmitting the load to the rail posts which are supported by the respective rakers. In the case of stable soils this shoring system can be installed and secured in place after the excavation is complete.

As described above, the intent of present invention is to provide a temporary shoring wall that is modular, having components which slide vertically relative to each other, so that it can be installed during the process of excavation. Another subject of this invention is to simply use an excavator for the installation and removal of the shoring wall unlike other retaining shoring systems requiring pre-installation of piles by drilling or using pile drivers. Actually, the most important aspect of this excavation is to replace soldier piles or sheet piles shoring walls in order to drastically reduce the cost of material, and the overall cost of installation of the temporary retaining walls. Another tremendous cost of traditional shoring systems is their removal to the point that they are often left in place. Yet, the subject of this invention is to provide a shoring system reducing the volume of work for a speedy removal of the shoring system.

Another substantial factor of this invention is its modular aspect, and the capacity to shore any shape of excavation using pre-manufactured component easily assembled in the job site.

The new features considered as characteristic for the invention are set forth in the appended claims. Other advantages of invention are to be appreciated in view of the following description and drawings.

DETAILED DESCRIPTION OF THE INVENTION

Figure 1:
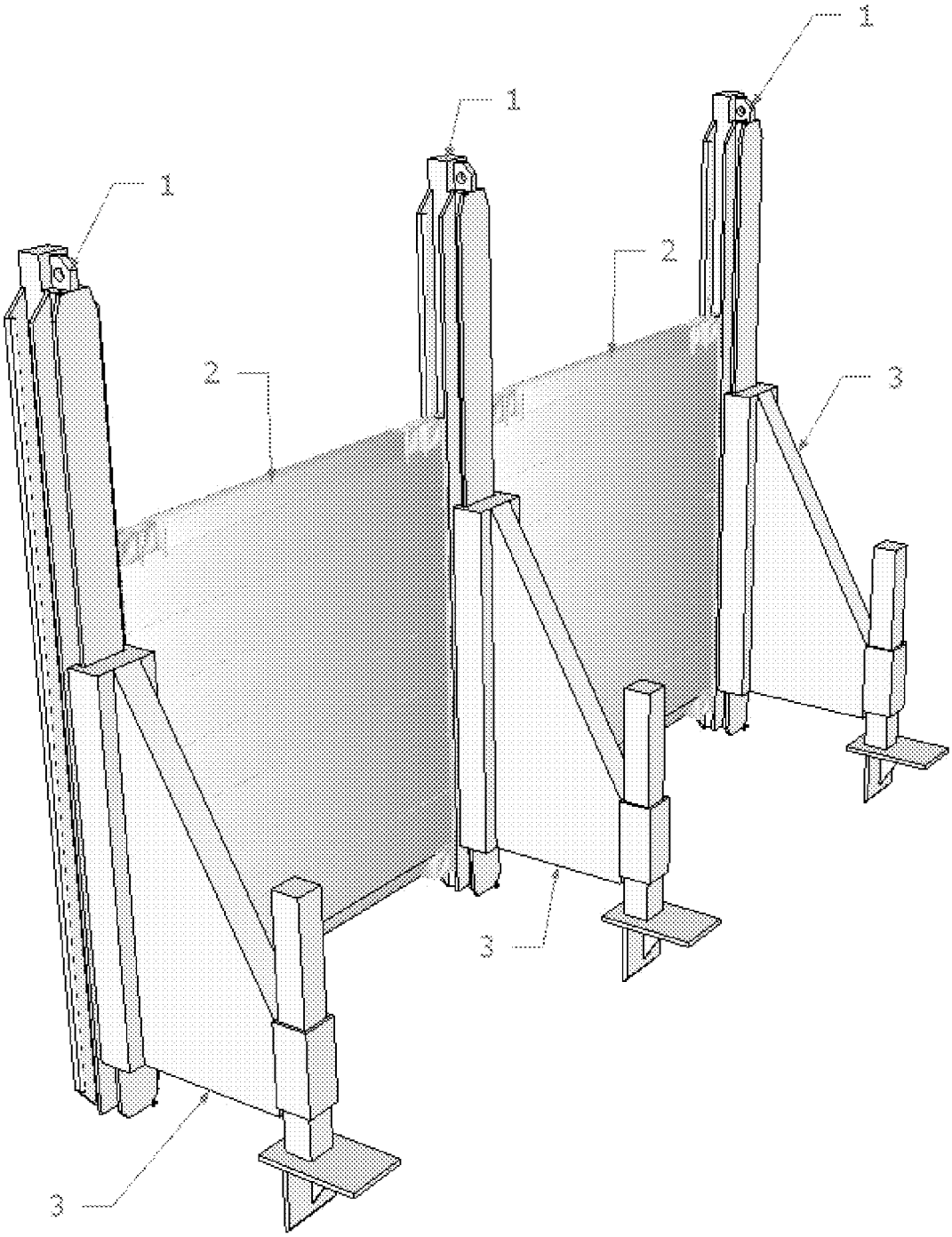
FIG. 1 is a three dimensional view of the modular shoring wall showing the rail posts, the shoring panels and the rakers.

Referring to the drawings where like numerals indicate like elements, various embodiments of present invention are illustrated.

FIG. 1 shows a three dimensional view a segment of the modular shoring wall comprising the rail posts 1, holding on each side the shoring panels 2 and the rakers 3 holding the respective rail posts 1. Behind the rail posts 1 and shoring panels 2 are the soils to be retained, not shown.

Figure 2:
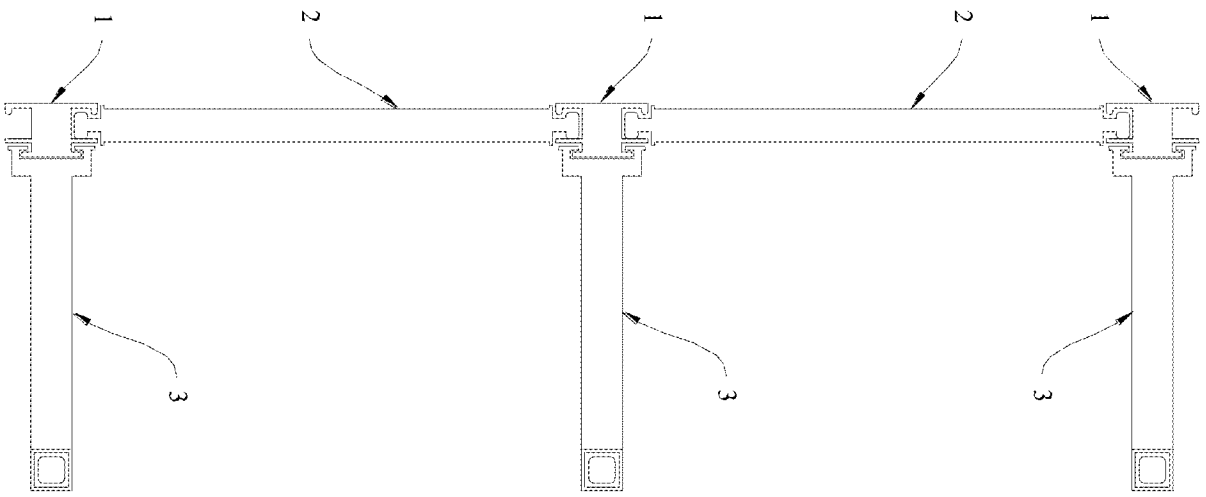
FIG. 2 is a top view of the FIG. 1 showing the cross section of the rail posts, panels and the rakers.

FIG. 2 shows a top view of a segment of the modular shoring wall in a straight line created by the panels 2 sliding within rail post 1 which are supported, or held vertically, by the rakers 3.

Figure 3:
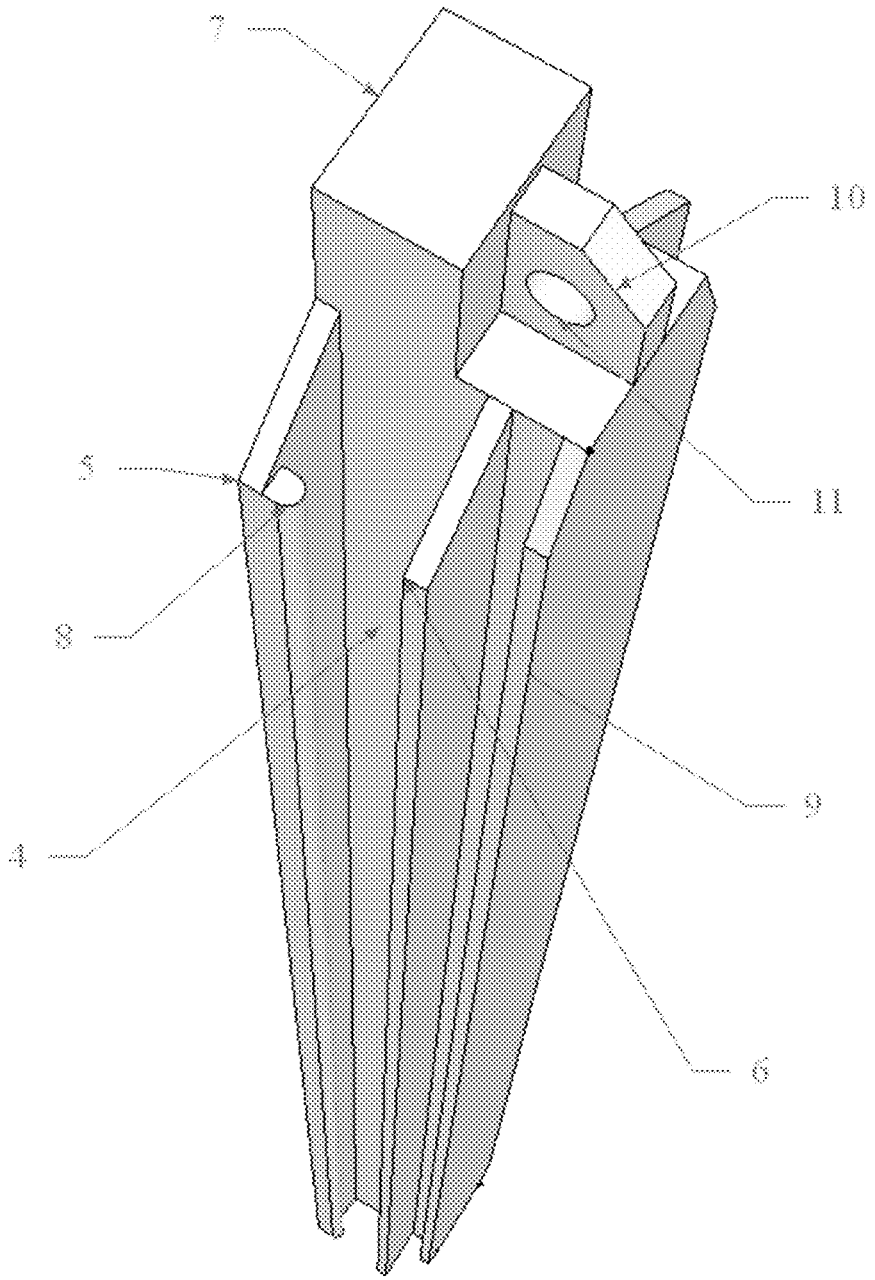
FIG. 3 is a three dimensional view of the rail post showing the panel guides and the frontal guide for the raker.

FIG. 3 shows a three dimensional view of the rail post 1 having on each side the vertical guide 4 shaped by the back plate 5 and the front plate 6. The back plate 5 has a locking bar 8 to interlock the shoring panel 2 sliding vertically within. On the front side of the rail post 1 there is a frontal edge guide 9 of T-shape to guide interlockingly the raker 3 sliding vertically over it. The rail post 1 is often provided with a pressing plate 7 to be taped with the bucket of excavator during the installation of shoring wall.

Figure 4:
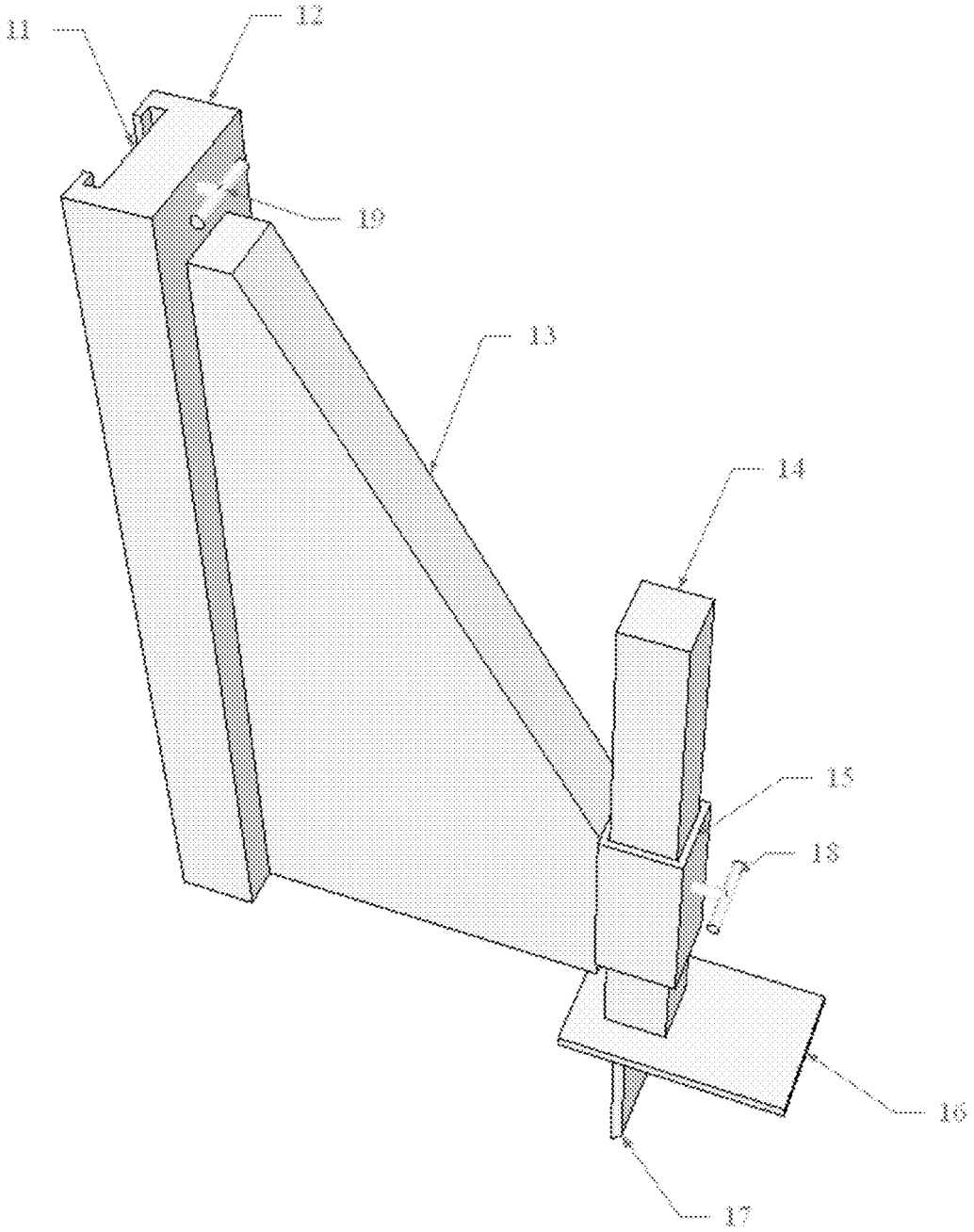
FIG. 4 is a three dimensional view of the raker showing the frontal guide and the tubular guide with the tamper.

FIG. 4 shows a three dimensional view of the raker 3 having a vertical member 12 provided with a C-shaped guide 11 adapted to encompass the T-shaped frontal edge guide 9 of the rail post 1. On the back side the body 13 of the raker 3 there is a tubular guide 15 allowing a tamper 14 to slide vertically within. The tamper 14 is provided with a pressing plate 16 and the knife plate 17 both acting against the ground to counteract the active pressure transmitted by the soils to the rail posts 1 via the panels 2. The raker 3 is also provided with stoppers 18 and 19. Once the installation is completed, the stopper 18 locks in place the tamper 14 while the stopper 19 restrain or locks in place the raker 3 relative to the rail post 1. Thus, after the installation, the raker 3 cannot slide over the rail post 1, and likewise the tamper 14 relative to the guide 15. The stoppers 18 and 19 can be of pinned type and/or of screw bolt pressing type.

Figure 5:
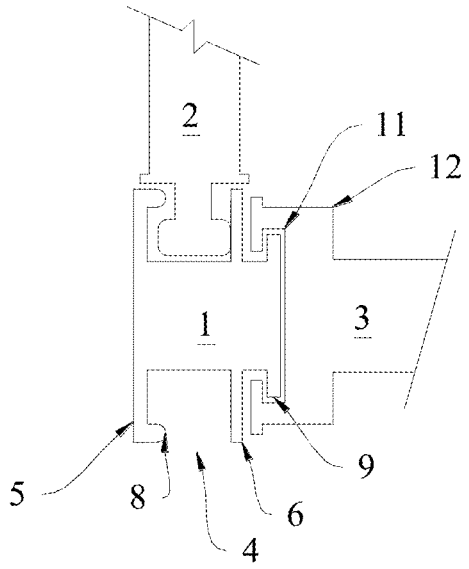
FIG. 5 is a sectional view of the rail post and the raker illustrating the interlocking between their respective guides.
Figure 6:
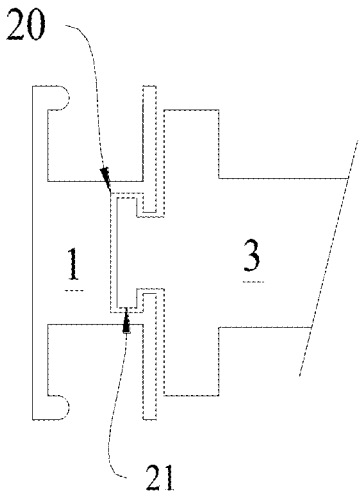
FIG. 6 is a sectional view of a variation of interlocking between rail post and the raker.

FIG. 5 shows a sectional view of the interlocking of the edge guide 9 of the rail posts 1 with the frontal guide 11 of the vertical member 12 of the raker 3. The shape of interlocking between rail post 1 and the raker 3 may vary and does not represent a limit of the invention. FIG. 6 shows a variation of the interlocking of the rail post 1 and the raker 3. The C-shaped guide 20 of the rail post 1 encompasses the T-shaped guide 21 of the raker 3.

Figure 7:
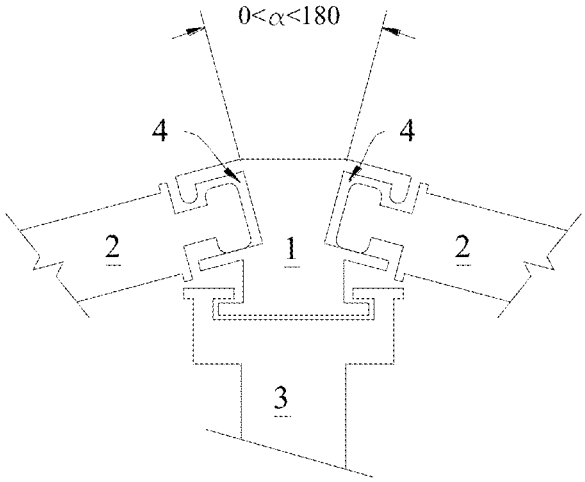
FIG. 7 is a top view of a variation of rail post for shoring of polygonal shaped wall.

FIG. 7, shows a variation of the cross section of the rail posts 1. In this variation, the lateral guides 4 on each side of the rail post 1 shape an angle $\alpha$ taking a value greater than 0 and less than 180 degrees. In this case, the panels 2 sliding on each side of the rail post 1 create an angle between 0 and 180 degrees to form successively a inner retaining wall of polygonal shape.

Figure 8:
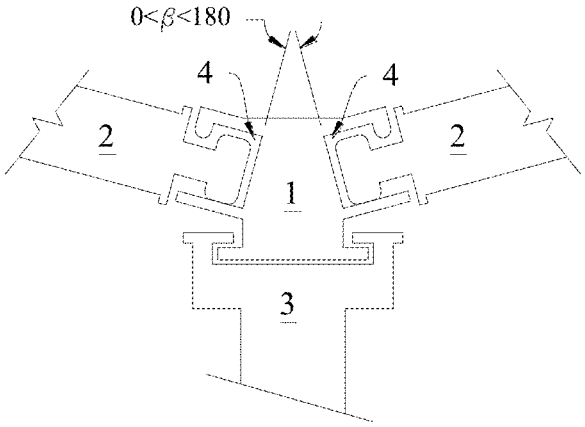
FIG. 8 is a top view of a variation of rail post for shoring zig-zag shaped wall.

FIG. 8 shows another variation of the cross section of the rail posts 1. In this variation, the lateral guides 4 on each side of the rail post 1 shape an angle $\beta$ taking a value greater than 0 and in less than 180 degrees. In this case, the panels 2 sliding on each side of the rail post 1 create an angle between 0 and 180 degrees to form successively an outer retaining wall of polygonal shape. The terms inner and outer are defined relative to the interior of excavation. When the rail posts 1 of FIG. 7 and FIG. 8 are combined together the shoring panels accommodate a zig-zag shape of the shoring wall.

Figure 9:
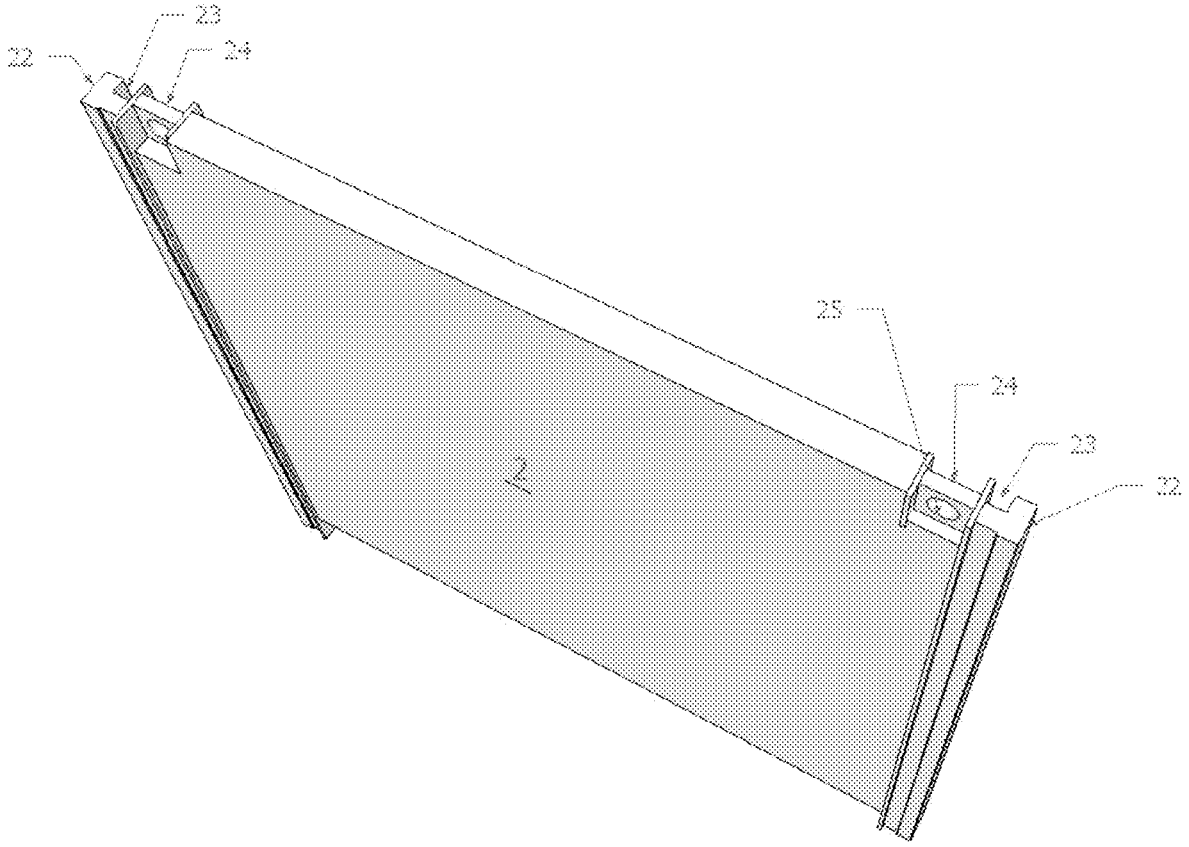
FIG. 9 is a three dimensional view of shoring panel showing the edge guides.

FIG. 9 shows a three dimensional view of the shoring panel 2 having on each side the edge guide 22 interlocking the locking bar 8 of the rail post 1 via the U-shaped guide 23. The shoring panel 2 is provided with lifting plates 24 with holes 25.

Figure 10:
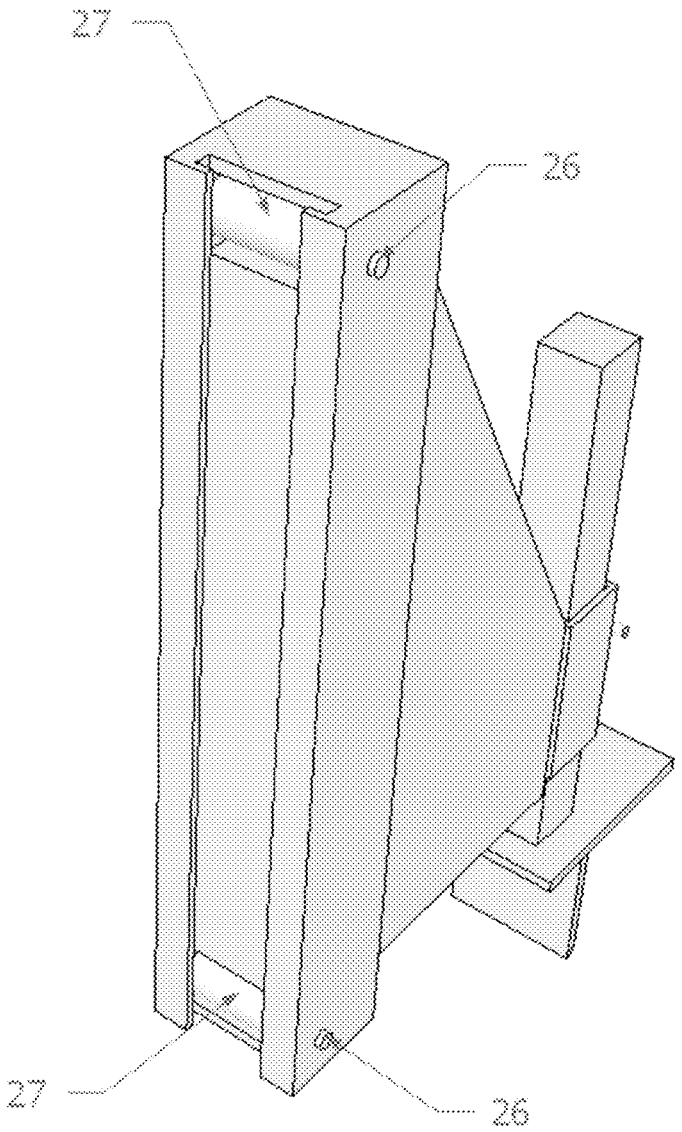
FIG. 10 is a three dimensional view of the raker provided with rollers.

FIG. 10 shows a three dimensional view of the raker 3 having at least two rollers 27 to ease the sliding of the raker 3 over the rail post 1 during the installation of the shoring. Each roller 27 is supported by the respective axle 26.

I claim:

1. A shoring system comprising:

a) rail posts, each said rail post having laterally on each side a panel guide adapted to interlock shoring panels sliding vertically within, each said rail post further having a frontal edge guide for sliding interlockingly at least one raker;

b) shoring panels, each said shoring panel having laterally on each end an edge guide to interlock but slide vertically within said panel guide of said rail post;

c) rakers, each said raker having a frontal guide adapted to slide formlockingly over the said frontal edge guide of said rail post, each said raker further having a tubular guide to slide vertically a tamper, said tamper designed to press onto the ground via a pressing plate and a knife plate to support the said rail post.

2. The shoring system of claim 1 wherein said panel guide of said rail post are aligned in a manner so that the said panels form conjointly an inner polygonal shape of retaining wall.

3. The shoring system of claim 1 wherein said panel guide of said rail post are aligned in a manner so that the said panels form conjointly an outer polygonal shape of the retaining wall.

4. The shoring system of claim 1 wherein said panel guide of said rail post are aligned in a manner so that the said panels form conjointly a zig-zag shape of the retaining wall.

5. The shoring system of claim 1 wherein said frontal guide of the said raker is provided with at least two rollers to ease the sliding over said rail post.

* * * * *